United States Patent [19]

Röck et al.

[11] Patent Number: 4,551,883

[45] Date of Patent: Nov. 12, 1985

[54] FURNITURE HINGE INCLUDING AXLE MEMBERS MOUNTING HINGE LINKS TO HINGE CASING

[75] Inventors: Erich Röck, Höchst; Klaus Brüstle, Lauterach, both of Austria

[73] Assignee: Julius Blum Gesellschaft m.b.H., Höchst, Austria

[21] Appl. No.: 586,765

[22] Filed: Mar. 6, 1984

[30] Foreign Application Priority Data

| | | | |
|---|---|---|---|
| Mar. 21, 1983 | [AT] | Austria | 976/83 |
| Dec. 19, 1983 | [AT] | Austria | 4416/83 |
| Dec. 19, 1983 | [AT] | Austria | 4417/83 |

[51] Int. Cl.[4] ..... E05D 3/06

[52] U.S. Cl. ..... 16/370; 16/386

[58] Field of Search ..... 16/282, 286, 287, 294, 16/302, 366, 370, 379, 386

[56] References Cited

U.S. PATENT DOCUMENTS

| | | | |
|---|---|---|---|
| 4,366,599 | 1/1983 | Zimmer et al. | 16/386 |
| 4,368,559 | 1/1983 | Oepping et al. | 16/386 |

FOREIGN PATENT DOCUMENTS

| | | | |
|---|---|---|---|
| 1285913 | 12/1968 | Fed. Rep. of Germany | 16/386 |
| 2029843 | 5/1978 | Fed. Rep. of Germany | 16/302 |

*Primary Examiner*—Fred A. Silverberg

*Attorney, Agent, or Firm*—Wenderoth, Lind & Ponack

[57] ABSTRACT

Hinge links of a hinge are mounted on a thin-walled hinge casing. An outer hinge link rests on pivot pins which are part of two axle members positioned to be mirror images of each other.

10 Claims, 6 Drawing Figures

FURNITURE HINGE INCLUDING AXLE MEMBERS MOUNTING HINGE LINKS TO HINGE CASING

FIELD AND BACKGROUND OF THE INVENTION

The invention relates to a furniture hinge comprising a hinge arm fastenable to a first furniture part and a hinge casing fittable into a second furniture part, the hinge arm and hinge casing being connected by means of inner and outer hinge links. Axles mount the hinge links in the hinge casing and on the hinge arm to form a hinge quadrangle. The outer hinge link is mounted in the hinge casing by axle members having two pivot pins and a connecting element extending through holes into the hinge casing. A space is provided between the ends of the pivot pins carrying the outer hinge link.

Such hinges are, for example, shown in the DE-OS No 29 26 486.

SUMMARY OF THE INVENTION

It is the object of the invention to improve the mounting of the hinge links in a hinge of this type such that, on the one hand, the hinge link has no bearing axle member which extends through the hinge casing, so that the space within the hinge link which is preferably designed with a U-shaped profile, is empty, and that, on the other hand, no axle member projects freely through the hinge casing.

While attaining these objects of the invention it must be ensured that the pivot pins for the hinge links in the hinge casing are aligned in a stable manner, even in the case of a thin and relatively weak hinge casing wall.

According to the invention this is achieved in that in the two hinge casing axle members are positioned to be mirror images of each other and that one pivot pin of each axle member projects into a holding sleeve or the like in the interior of the hinge casing.

It is advantageously provided that the two axle members each have a longer and a shorter pivot pin, and that the longer pivot pin extends into the holding sleeve of the hinge casing, whereas the two shorter pivot pins jointly carry the outer hinge link.

The stability of the axle members can be substantially improved if the members were welded, soldered or glued to the hinge casing.

In an embodiment of this type an absolutely secure alignment of the pivot pins is obtained. Furthermore, the forces acting on the pivot pins can be transmitted to the hinge casing over a relatively large area of contact.

Such an embodiment of the invention provides that the axle members are at their connecting parts welded, soldered or glued to the hinge casing.

The hinge casing according to the invention is advantageously punched of sheet steel, and the holding sleeve is formed by a curled flap punched from the bottom of the hinge casing.

In an embodiment of the invention the length of each longer pivot pin corresponds substantially to half the inside width of the hinge casing in the region of the axle members and in the direction of the axles.

A further embodiment of the invention provides that the two axle members jointly carry the inner and the outer hinge links, and that the sleeve extends over the pivot pins for the inner hinge link. In this manner, a lamella-like inner hinge link may be mounted on the axle members according to the invention.

BRIEF DESCRIPTION OF THE DRAWINGS

Two embodiments of the invention will be now described in more detail with reference to the accompanying drawings, wherein.

DETAILED DESCRIPTION OF THE INVENTION

Figure 1:
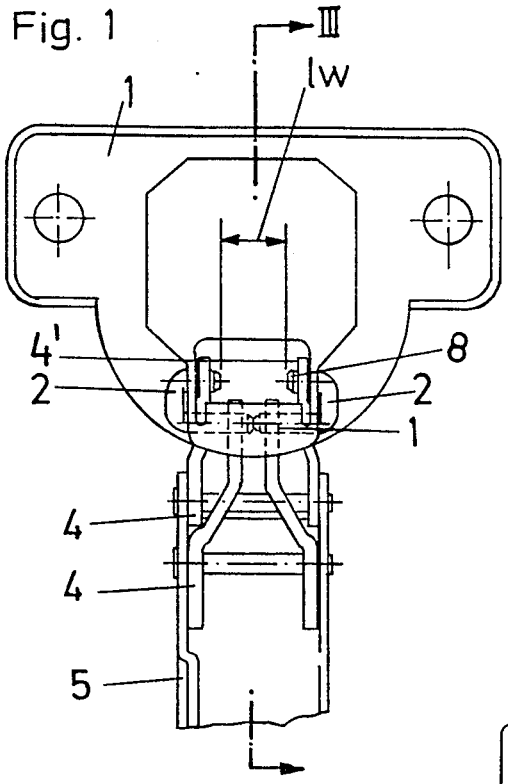
FIG. 1 is a top view of the lower side of a furniture hinge according to the invention.
Figure 2:
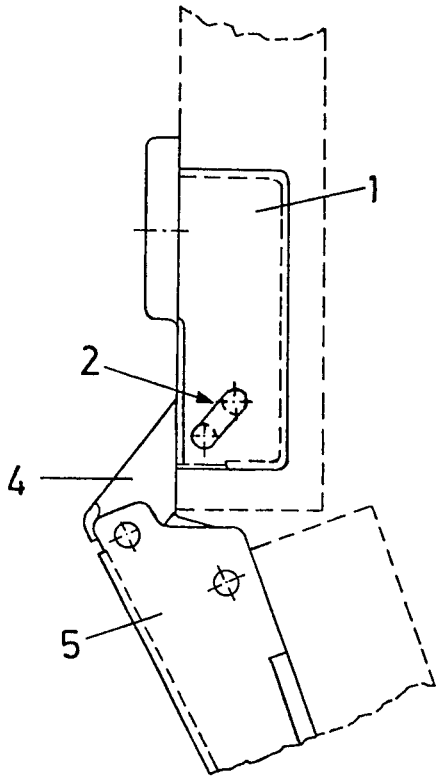
FIG. 2 is a side view of the furniture hinge.
Figure 3:
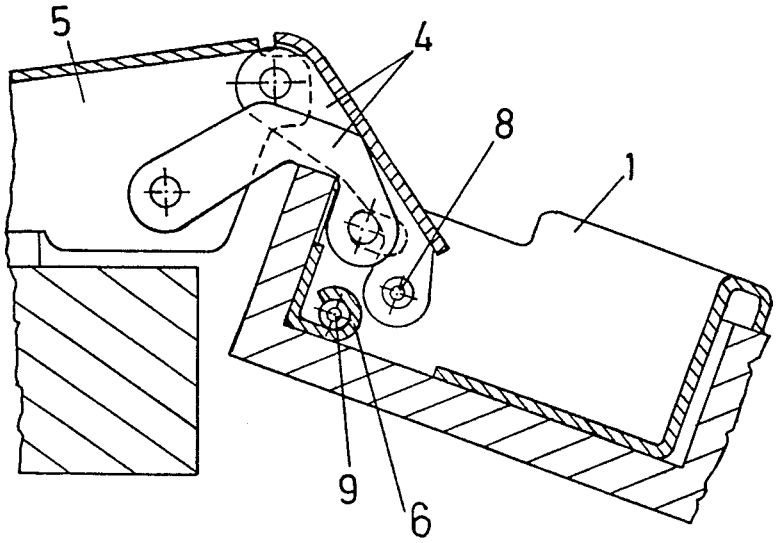
FIG. 3 is a section along line III—III of FIG. 1.
Figure 4:
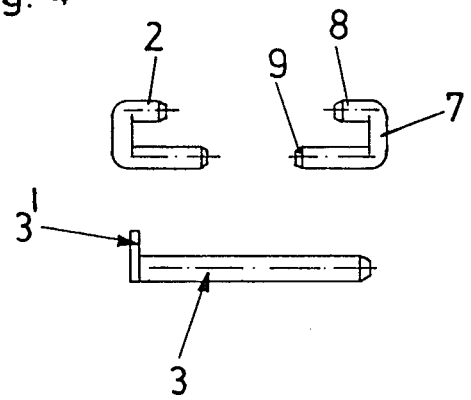
FIG. 4 is an exploded schematic view of the hinge parts which form the hinge axles.

In the drawing the adjusting and fastening screws for a hinge arm 5 as well as the base plate have not been illustrated, since such parts are intended to be according to the known state of the art and are not the subject of this invention.

On the side of the furniture door, the hinge according to the invention includes a hinge casing 1 to which are mounted inner and outer hinge links 4.

The outer hinge link 4 is mounted on pivot pins 8 which form parts of two U-shaped axle members 2 which also includes pivot pins 9. A connecting member 7 of each axle member 2 extends between the respective pivot pins 8, 9.

The pivot pins 9 are longer than the pivot pins 8, and the two axle members 2 are positioned to be mirror images of each other.

The outer hinge link 4 has a U-shaped profile cross-section, and due to the design of the axle members 2 according to the invention the inside width W between lateral flanges 4' of the outer hinge link 4 is free.

The two longer pivot pins 9 of the axle members 2 project into a holding sleeve or ring 6 so that the stable alignment of the pivot pins 8 is also ensured, when a force from the hinge link 4 acts on them. The holding sleeve 6 is, in the embodiment according to FIGS. 1 to 4, formed by a curled flap punched from the bottom of the hinge casing 1. The two pivot pins 9 extend in this embodiment to the longitudinal central plane of the hinge casing 1 which corresponds to the line III—III shown in FIG. 1.

The inner hinge link 4 is, in this embodiment, mounted on an axle 3 which extends, in a manner known per se, through the hinge casing 1. The axle 3 has a stop 3' to facilitate mounting operations.

The axle members 2 may have flattened connecting members 7 to provide a better connecting surface with the hinge casing 1.

Figure 5:
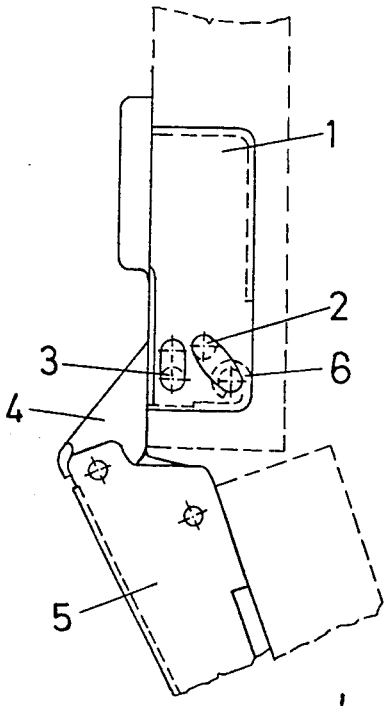
FIG. 5 is a side view similar to FIG. 2 but of a hinge of a further embodiment.
Figure 6:
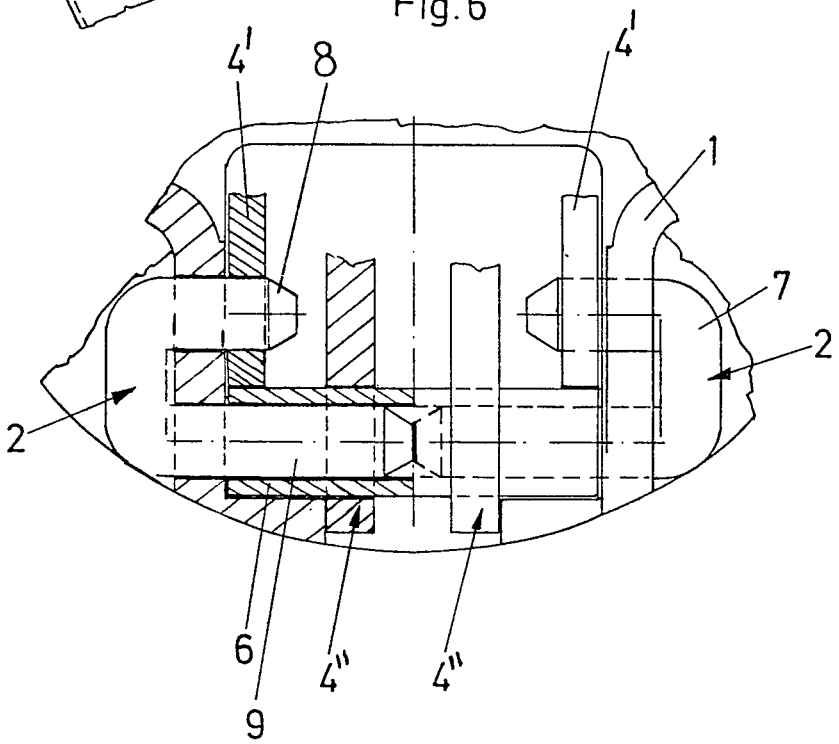
FIG. 6 is a horizontal sectional view of a hinge casing in the region of the hinge axles.

In the embodiment according to FIGS. 5 and 6, the two axle members 2 carry both hinge links 4.

The outer hinge link 4 is mounted on the two shorter pivot pins 8. Outer hinge link 4 has, like in the aforedescribed embodiment, also a U-shaped profile in cross-section, and due to the design of the axle members 2 according to the invention the inside width between the lateral flanges 4' of the outer hinge link 4 is free.

The lateral flanges 4'' of inner hinge link 4 are mounted about the sleeve 6 which fits over pivot pins 9.

The sleeve 6 is advantageously of metal, but plastic material also may be employed.

What is claimed is:

1. A furniture hinge comprising:

a hinge arm to be mounted on a furniture body;

a hinge casing to be fitted to a furniture door;

inner and outer hinge links having first ends pivoted to said hinge arm and second ends pivoted to said hinge casing; and means pivotally mounting said second end of said outer hinge link to said hinge casing, said mounting means comprising first and second axle members, each said axle member including first and second pivot pins extending parallel to each other and joined by a transversely extending connecting element, said first pivot pins being shorter than said second pivot pins, said first and second axle members positioned as mirror images of each other with said pivot pins extending through spaced walls of said hinge casing into the interior thereof, with said first pivot pins directed toward each other along substantially the same axis with a space therebetween, and with said second pivot pins directed toward each other along substantially the same axis, said second end of said outer hinge link being pivotally mounted on said first pivot pins, and a holding sleeve fixedly positioned in said interior of said hinge casing, said second pivot pins extending into said sleeve.

2. A hinge as claimed in claim 1, wherein ends of said second pivot pins abut within said sleeve.

3. A hinge as claimed in claim 1, wherein said axle members are fixed to said hinge casing.

4. A hinge as claimed in claim 3, wherein said connecting elements are fixed to said hinge casing.

5. A hinge as claimed in claim 1, wherein said hinge casing is formed of sheet steel.

6. A hinge as claimed in claim 1, wherein said sleeve is formed of a curled flap punched from the material of the bottom of said hinge casing.

7. A hinge as claimed in claim 1, wherein the length of each said second pivot pin equals substantially half the interior dimension of said hinge casing in the axial direction of said second pivot pins.

8. A hinge as claimed in claim 1, wherein said second end of said inner hinge link is pivotally mounted about said sleeve.

9. A hinge as claimed in claim 8, wherein the length of said sleeve substantially equals the interior dimension of said hinge casing in the axial direction of said second pivot pins.

10. A hinge as claimed in claim 8, wherein said second end of said inner hinge link is mounted about said sleeve by means of flanges extending transverse to the axial direction of said second pivot pins.

* * * * *